US008292603B2

(12) United States Patent
Nakamura et al.

(10) Patent No.: US 8,292,603 B2
(45) Date of Patent: Oct. 23, 2012

(54) ROTARY VACUUM PUMP, VACUUM DEVICE, AND PUMP CONNECTION STRUCTURE

(75) Inventors: Fusao Nakamura, Tenri (JP); Osamu Ashida, Hadano (JP); Kohei Oue, Isehara (JP)

(73) Assignee: Shimadzu Corporation, Kyoto-Shi (JP)

( * ) Notice: Subject to any disclaimer, the term of this patent is extended or adjusted under 35 U.S.C. 154(b) by 1957 days.

(21) Appl. No.: 11/181,906

(22) Filed: Jul. 15, 2005

(65) Prior Publication Data

US 2006/0024184 A1 Feb. 2, 2006

(30) Foreign Application Priority Data

Jul. 30, 2004 (JP) ..... 2004-223265
Apr. 12, 2005 (JP) ..... 2005-114519

(51) Int. Cl.
*F04B 35/04* (2006.01)
*F01D 21/00* (2006.01)

(52) U.S. Cl. ..... 417/423.4; 415/9

(58) Field of Classification Search ..... 417/423.15, 417/423.4, 424.1; 411/353; 415/9
See application file for complete search history.

(56) References Cited

U.S. PATENT DOCUMENTS 2,060,593 A * 11/1936 Schaurte et al. ..... 470/11
4,536,112 A * 8/1985 Horsky et al. ..... 409/134
4,687,365 A * 8/1987 Promersberger ..... 403/2
4,830,324 A * 5/1989 Neville ..... 248/425
5,183,400 A * 2/1993 Tada et al. ..... 417/572
6,575,713 B2 * 6/2003 Ohtachi et al. ..... 417/353
6,589,009 B1 * 7/2003 Shiokawa et al. ..... 415/90
6,752,588 B2 * 6/2004 Kawanishi et al. ..... 415/90
6,824,349 B2 * 11/2004 Okudera et al. ..... 415/9
6,854,956 B2 * 2/2005 Miwata et al. ..... 415/90
6,899,529 B2 * 5/2005 Ishikawa et al. ..... 417/363
2003/0095863 A1 * 5/2003 Okudera et al. ..... 415/90
2004/0042690 A1 * 3/2004 Nakamura et al. ..... 384/55
2004/0042873 A1 * 3/2004 Burmahln ..... 411/353
2004/0081569 A1 * 4/2004 Sakaguchi et al. ..... 417/423.4
2005/0079068 A1 * 4/2005 Shigematsu ..... 417/363

FOREIGN PATENT DOCUMENTS

JP 2003148388 A * 5/2003

* cited by examiner

*Primary Examiner* — Devon Kramer
*Assistant Examiner* — Alexander Comley
(74) *Attorney, Agent, or Firm* — Manabu Kanesaka

(57) ABSTRACT

A rotary vacuum pump includes a pump casing on which an intake port flange is formed, a rotor which has a rotating side evacuating device and is driven to rotate at high speed inside the pump casing, and a fixing side evacuating device which is provided inside the pump casing and generates an evacuating effect together with the rotating side evacuating device. The intake port flange is fastened to a device subject to evacuating by a bolt. A through-hole is formed in the intake port flange for inserting the bolt and has a diameter larger than that of the bolt. A gap forming device for forming a gap between the bolt and the through-hole in the intake port flange is provided on a matching surface of the through-hole.

14 Claims, 15 Drawing Sheets

Fig. 8(a)
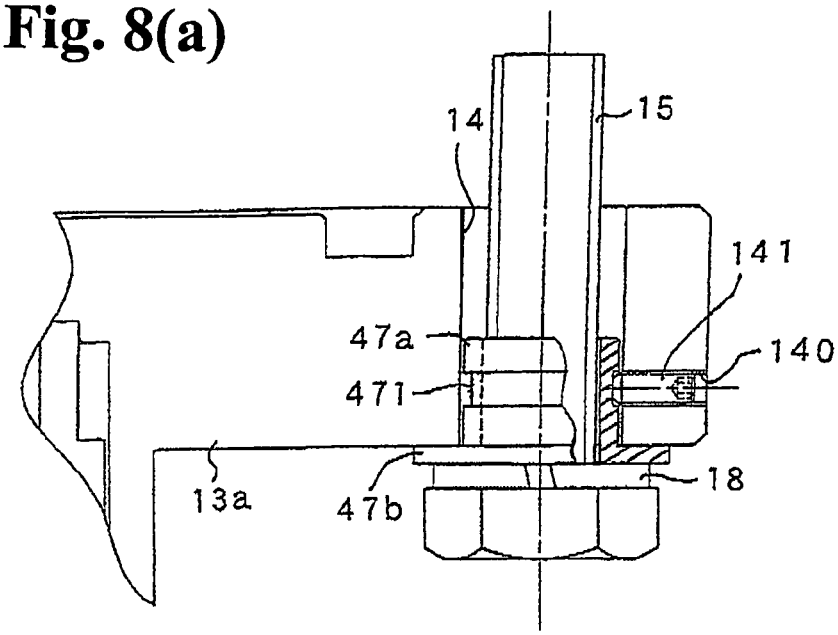
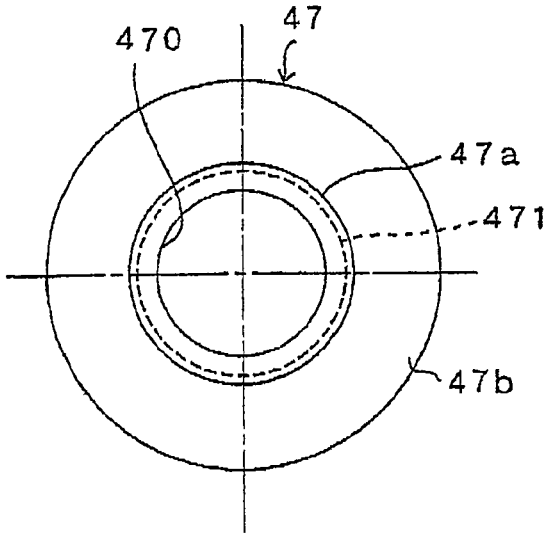
Fig. 8(b)
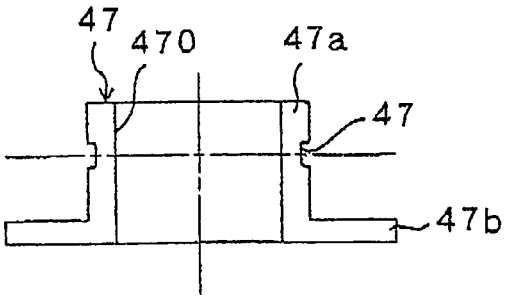
Fig. 8(c)

Fig. 9(a)
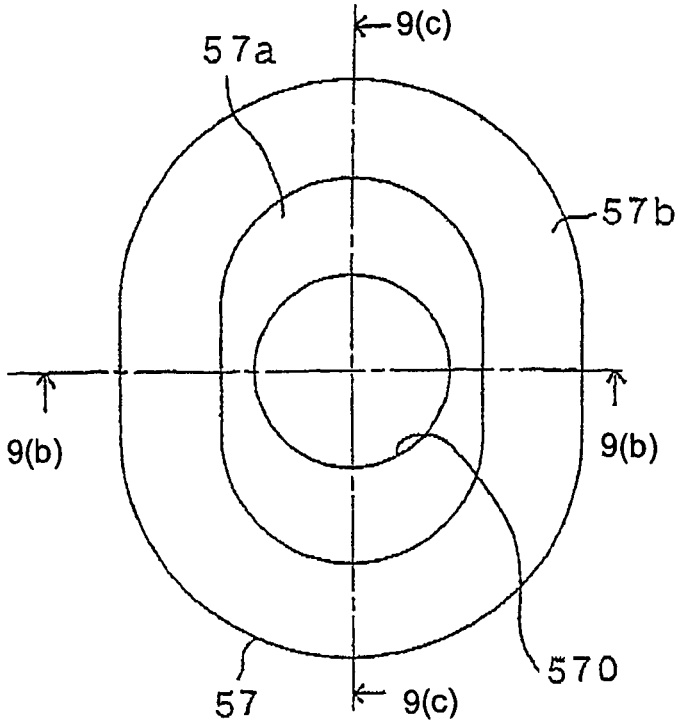
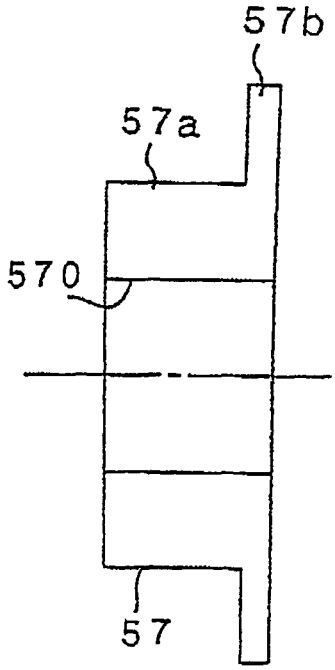
Fig. 9(c)
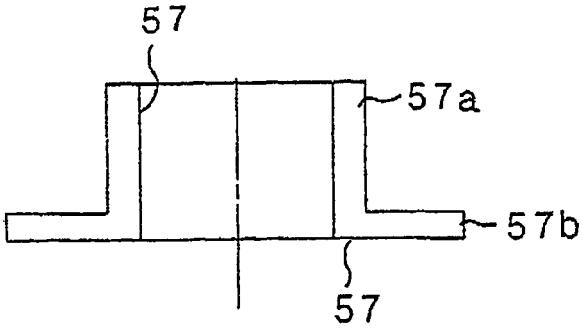
Fig. 9(b)

ROTARY VACUUM PUMP, VACUUM DEVICE, AND PUMP CONNECTION STRUCTURE

BACKGROUND OF THE INVENTION AND RELATED ART STATEMENT

The present invention relates to a rotary vacuum pump such as a turbo molecular pump or a molecular drag pump, a vacuum device provided with the rotary vacuum pump, and a pump connection structure.

A turbo molecular pump, which is used for high-vacuum evacuation, comprises plural stages of rotating fins and plural stages of fixed fins, which are placed alternately. Each rotating fin and fixed fin comprises plural turbine blades. The rotating fins are formed on a rotor which is driven by a motor, and the fixed fins are fixed to a base of the pump. A turbo molecular pump, which has a drag pump section in addition to the above-described turbine blades, is known. The drag pump section has a cylindrical part which is formed on a lower part of the rotor, and a screw groove stator which is provided near the cylindrical part.

In such a turbo molecular pump, the rotor on which the turbine blades and the cylindrical part are formed rotates at a high speed of several tens of thousands of rpm. If it is subject to abnormal external disturbance, there is a concern that the rotor and the stator side (for example, screw groove stator) may contact. In that case, a large impact may be applied to the stator side. Also, the rotor which rotates at high speed is normally subject to a large centrifugal force. Accordingly, there is a concern that the rotor may be broken when the rotor and the stator contact or the pump is operated continuously under conditions exceeding design limits. In such cases, there is a problem that a larger impact is applied to the stator, and a great shear force is applied to bolts that fasten the pump casing to the device main body.

A pump with bolt holes having plural steps expanding outwardly is known (for example, see Patent Document 1), so that a shear force is not concentrated in one place, thereby preventing breakage of bolts.

Patent Document 1: Japanese Patent Publication (Kokai) No. 2003-148388

In order to form the bolt holes having the plural steps expanding outwardly, a machining process becomes complex, thereby increasing cost. In the conventional pump, the bolts contact side faces of the stepped holes and elastically deform to absorb an impact force. However, due to the stepped hole, it is difficult to obtain sufficient elastic deformation.

The present invention has been made to obviate the above problems, and an object of the invention is to provide an improved rotary vacuum pump, a vacuum device provided with the rotary vacuum pump, and an improved pump connection structure.

Further objects and advantages of the invention will be apparent from the following description of the invention.

SUMMARY OF THE INVENTION

In order to attain the objects described above, according to a first aspect of the present invention, a rotary vacuum pump comprises a pump casing on which an intake port flange is formed; a rotor which has a rotating side evacuating device and is driven to rotate at high speed inside the pump casing; and a fixing side evacuating device which is provided inside the pump casing and generates an evacuating effect in concert with the rotating side evacuating device. The intake port flange is fastened to a device subject to evacuating by a bolt.

A through-hole is formed in the intake port flange for inserting the bolt and has a diameter larger than that of the bolt. A gap forming device which forms a gap between the bolt and the through-hole in the intake port flange is provided on a matching surface of the through-hole.

According to a second aspect of the present invention, in the rotary vacuum pump in the first aspect, the gap forming device is a bush which is inserted between the bolt and the through-hole.

According to a third aspect of the present invention, in the rotary vacuum pump in the second aspect, the bush forms a gap in a rotor rotation direction that is larger than a gap formed in a diameter direction of the intake port flange.

According to a fourth aspect of the present invention, in the rotary vacuum pump in one of the second and third aspects, the bush is fixed to the through-hole.

According to a fifth aspect of the present invention, in the rotary vacuum pump in one of the second to fourth aspects, the bush and a washer for the bolt are integrally formed.

According to a sixth aspect of the present invention, in the rotary vacuum pump in the first aspect, the gap forming device is made as a large-diameter part which is formed on a shaft of the bolt near a bolt head and has an outer diameter almost equal to an inner diameter of the through-hole.

According to a seventh aspect of the present invention, a vacuum device is to be attached to the rotary vacuum pump in one of the first to sixth aspects. The vacuum device includes a pump supporting part fixed to an end surface of the pump main body of the rotary vacuum pump in the rotating shaft direction by bolt; a through-hole for a bolt formed in the pump supporting part and having a diameter larger than a diameter of the bolt; and a gap forming device for forming a gap in an end surface of the through-hole between the bolt and the through-hole.

According to an eighth aspect of the present invention, a pump connection structure connects an intake port flange of a rotary vacuum pump for evacuating a gas by high-speed rotation of a rotor against a stator to a connection flange of a member connected thereto. The pump connection structure comprises a through-hole for a bolt which is formed in one of the intake port flange and the connection flange and has a diameter larger than a diameter of the bolt; and a gap forming device which forms a gap in an intake port flange matching surface of the through-hole between the bolt and the through-hole.

According to a ninth aspect of the present invention, a pump connection structure connects a rotary vacuum pump for evacuating a gas by high-speed rotation of a rotor against a stator to a vacuum device by means of a piping member. The pump connection structure comprises a bolt which fastens a connection flange of the piping member and a connection flange of the vacuum device; a through-hole for bolt which is formed in one of the two connection flanges and has a diameter larger than a diameter of the bolt; and a gap forming device which forms a gap in the flange matching surface of the through-hole between the bolt and the through-hole.

According to a tenth aspect of the present invention, in the pump connection structure in one of the eighth and ninth aspects, a bush which is inserted between the bolt and the through-hole is used as the gap forming device.

According to an eleventh aspect of the present invention, in the pump connection structure in the tenth aspect, the bush forms a gap in a rotor rotation direction larger than a gap formed in a diameter direction of the intake port flange.

According to a twelfth aspect of the present invention, in the pump connection structure in one of the tenth and eleventh aspects, the bush is fixed to the through-hole.

According to a thirteenth aspect of the present invention, in the pump connection structure in one of the eighth to twelfth aspects, the bush part and a washer for the bolt are integrally formed.

According to a fourteenth aspect of the present invention, in the pump connection structure in one of the eighth and ninth aspects, the gap forming device is made as a large-diameter part which is formed on a shaft of the bolt near a bolt head and has an outer diameter almost equal to an inner diameter of the through-hole.

In the first aspect, the gap forming device is provided for forming a gap that allows the bolt to deform. When the intake port flange moves against the device subject to evacuating due to an impact, the movement of the intake port flange can be suppressed by the generation of strain energy accompanying deformation of the bolt. In addition, the impact transmitted to the device subject to evacuating can be reduced. In the seventh to ninth aspects, the impact on the connection target members such as the vacuum chamber, piping member, and the like, can be reduced.

BRIEF DESCRIPTION OF THE DRAWINGS

FIGS. 8(*a*) to 8(*c*) are views showing a special washer according to a third modified example, wherein FIG. 8(*a*) is a view showing the special washer attached to a bolt hole, FIG. 8(*b*) is a plan view of the special washer, and FIG. 8(*c*) is a sectional view of the special washer;

FIGS. 9(*a*) to 9(*c*) are views showing a special washer according to a fourth modified example, wherein FIG. 9(*a*) is a plan view of the special washer, FIG. 9(*b*) is a sectional view taken along 9(*b*)-9(*b*) in FIG. 9(*a*), and FIG. 9(*c*) is a sectional view taken along 9(*c*)-9(*c*) in FIG. 9(*a*);

DETAILED DESCRIPTION OF PREFERRED EMBODIMENTS

Hereunder, embodiments of the present invention will be explained with reference to the accompanying drawings.

First Embodiment

Figure 1B:
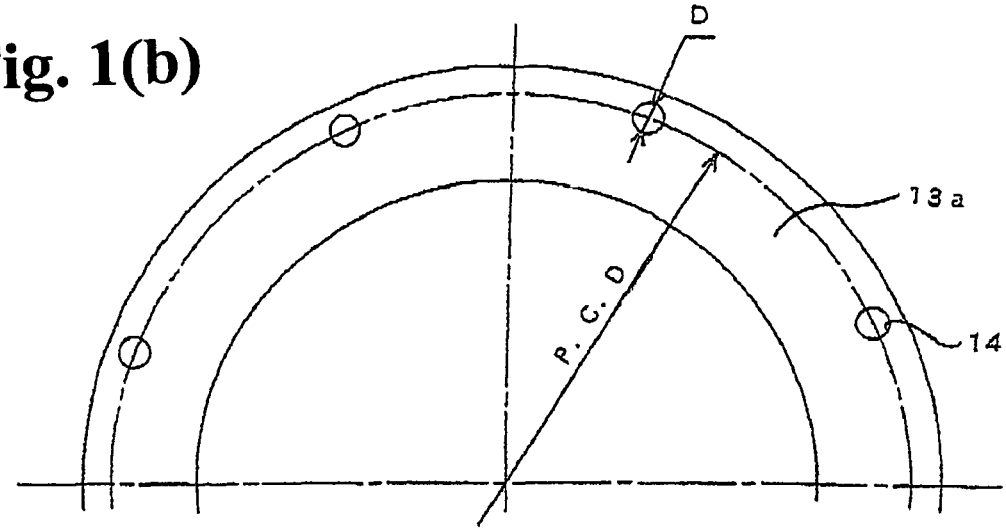
FIGS. 1(*a*) and 1(*b*) are views showing a rotary vacuum pump according to a first embodiment of the present invention, wherein FIG. 1(*a*) is a sectional view of a turbo molecular pump, and FIG. 1(*b*) is a plan view showing a flange part.
Figure 1A:
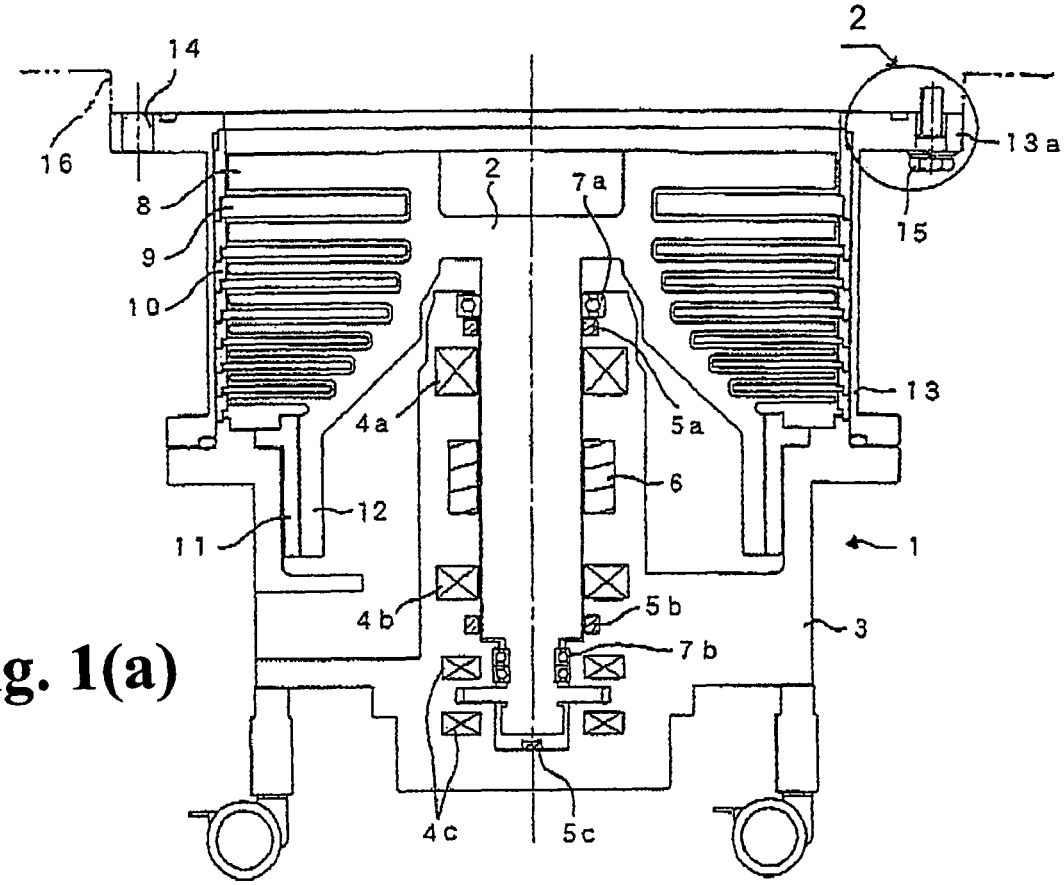

FIGS. 1(*a*) and 1(*b*) are views showing a molecular drag pump as a rotary vacuum pump according to a first embodiment of the present invention, wherein FIG. 1(*a*) is a sectional view of a turbo molecular pump, and FIG. 1(*b*) is a plan view showing a flange part. The plan view shows an upper half of the flange. A turbo molecular pump 1 shown in FIGS. 1(*a*) and 1(*b*) is a magnetic bearing type pump, and the rotor 2 is supported by magnetic bearings 4*a*-4*c* provided on a base 3 without contact. Reference numerals 4*a* and 4*b* are radial magnetic bearings, and reference numeral 4*c* is an axial magnetic bearing.

On the base 3, a motor 6 which drives the rotor 2 to rotate, touch down bearings 7*a* and 7*b*, and gap sensors 5*a*, 5*b* and 5*c* for detecting a position of levitation of the rotor 2 respectively are provided. For the touch down bearings 7*a* and 7*b*, mechanical bearings are used, and they support the rotor 2 when the magnetic levitation of the rotor 2 by the magnetic bearings 4*a*-4*c* is turned off.

On the rotor 2, plural stages of rotating fins 8 are formed in a rotating shaft direction. Fixed fins 9 are provided respectively between vertically arranged rotating fins 8. The turbine fin section of the turbo molecular pump 1 is constituted by the rotating fins 8 and fixed fins 9. Each fixed fin 9 is supported in a manner so as to be sandwiched above and below by a spacer 10. The spacer 10 has the function of holding the fixed fins 9, and also the function of keeping the gap between the fixed fins 9 to a prescribed distance.

A screw stator 11 which constitutes the drag pump stage is provided in a section to the rear (downwardly in the illustration) of the fixed fins 9, and the inner perimeter face of the screw stator 11 faces the cylindrical part 12 of the rotor 2 at a prescribed distance. The fixed fins 9 which are supported by the rotor 2 and the spacers 10 are held inside a casing 13 on which an intake port flange 13*a* is formed. In the intake port flange 13*a*, bolt holes 14 are formed at eight places at equal intervals, and the intake port flange 13*a* is fixed by eight bolts 15 to a flange 16 on the device side. The flange thickness, used bolt dimensions, and number of bolts are determined by standards according to the size of the diameter of the intake port flange 13*a*.

Figure 2:
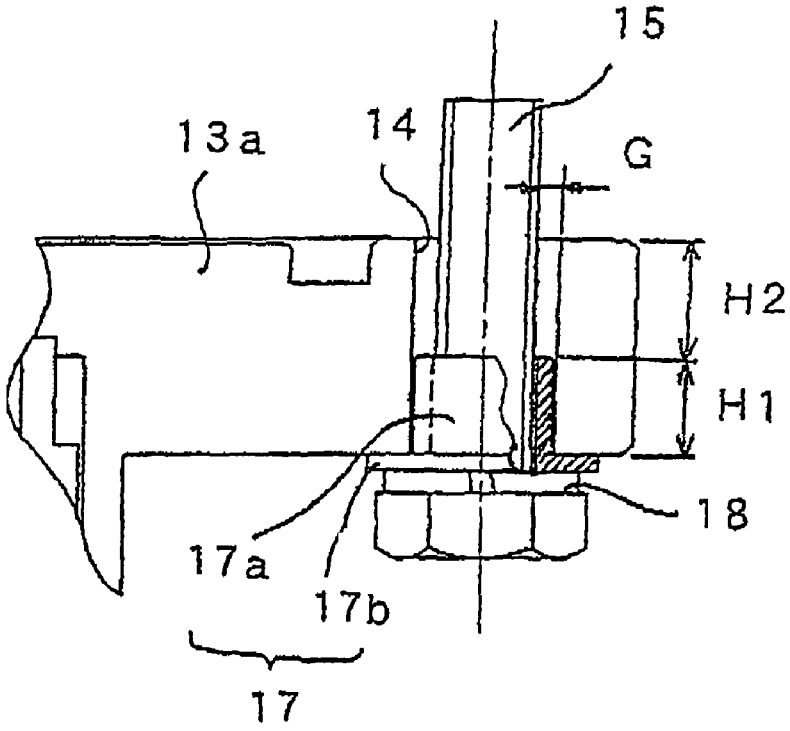
FIG. 2 is an enlarged view of part 2 in FIG. 1(*a*)
Figure 3A:
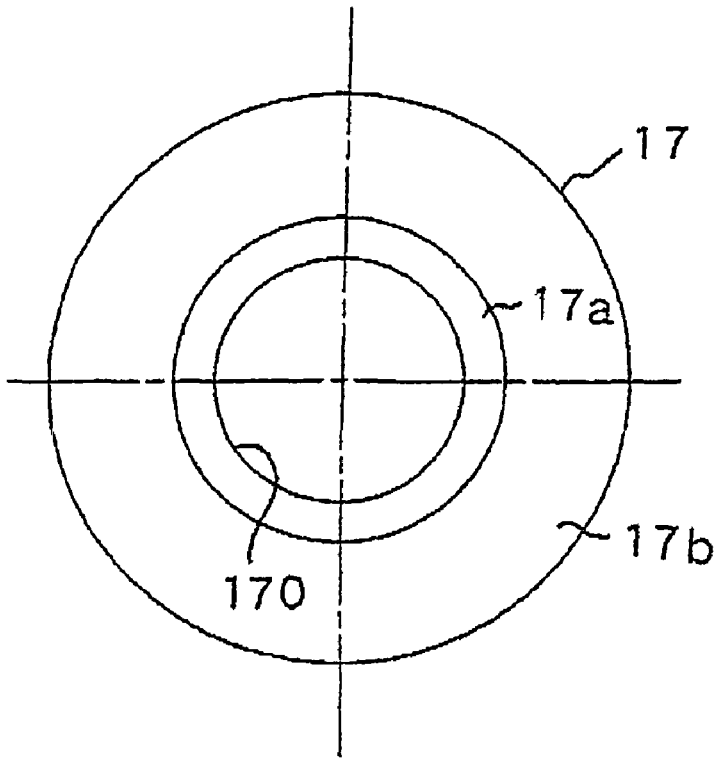
FIG. 3(*a*) is a plan view of a special washer, and FIG. 3(*b*) is a sectional view thereof.
Figure 3B:
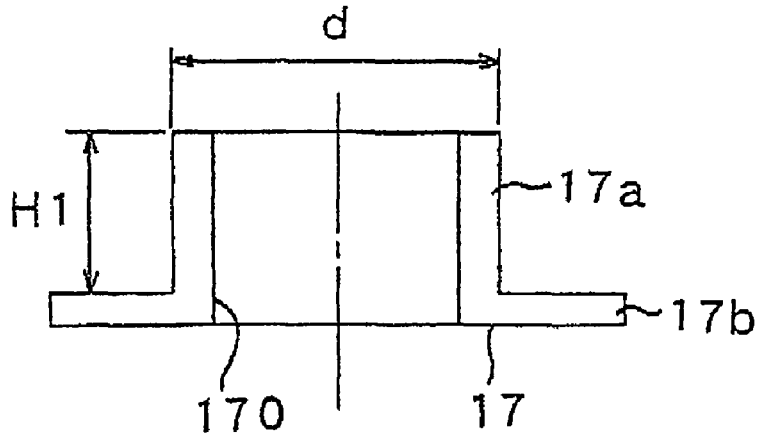

FIG. 2 is an enlarged view of part 2 in FIG. 1(*a*), and shows the details of the bolt hole 14 of the intake port flange 13*a*. When fixing the intake port flange 13*a* to the device side flange using the bolts 15, special washers 17 as shown in FIGS. 3(*a*) and 3(*b*) are used. Reference numeral 18 is an ordinary spring washer. FIG. 3(*a*) is a plan view of the special washer 17, and FIG. 3(*b*) is a sectional view thereof. The special washer 17 has a bush part 17*a* and a flange part 17*b*, and is made of iron or stainless steel, or the like. In the bush part 17*a*, a hole 170 in which the bolt 15 is inserted is formed.

An inner diameter D of the bolt hole 14 formed in the intake port flange 13*a* is larger than the standard bolt aperture corresponding to the dimensions of the bolt 15 as described later.

An external dimension d of the bush part 17*a* of the special washer 17 should be set as the margin dimension such that it can be inserted easily into the bolt hole 14, and the height dimension is defined as H1. Therefore, from the upper face of the intake port flange 13*a* to the depth of H2 as shown in FIG. 2, a gap G is formed between the bolt 15 and the bolt hole 14.

Figure 4:
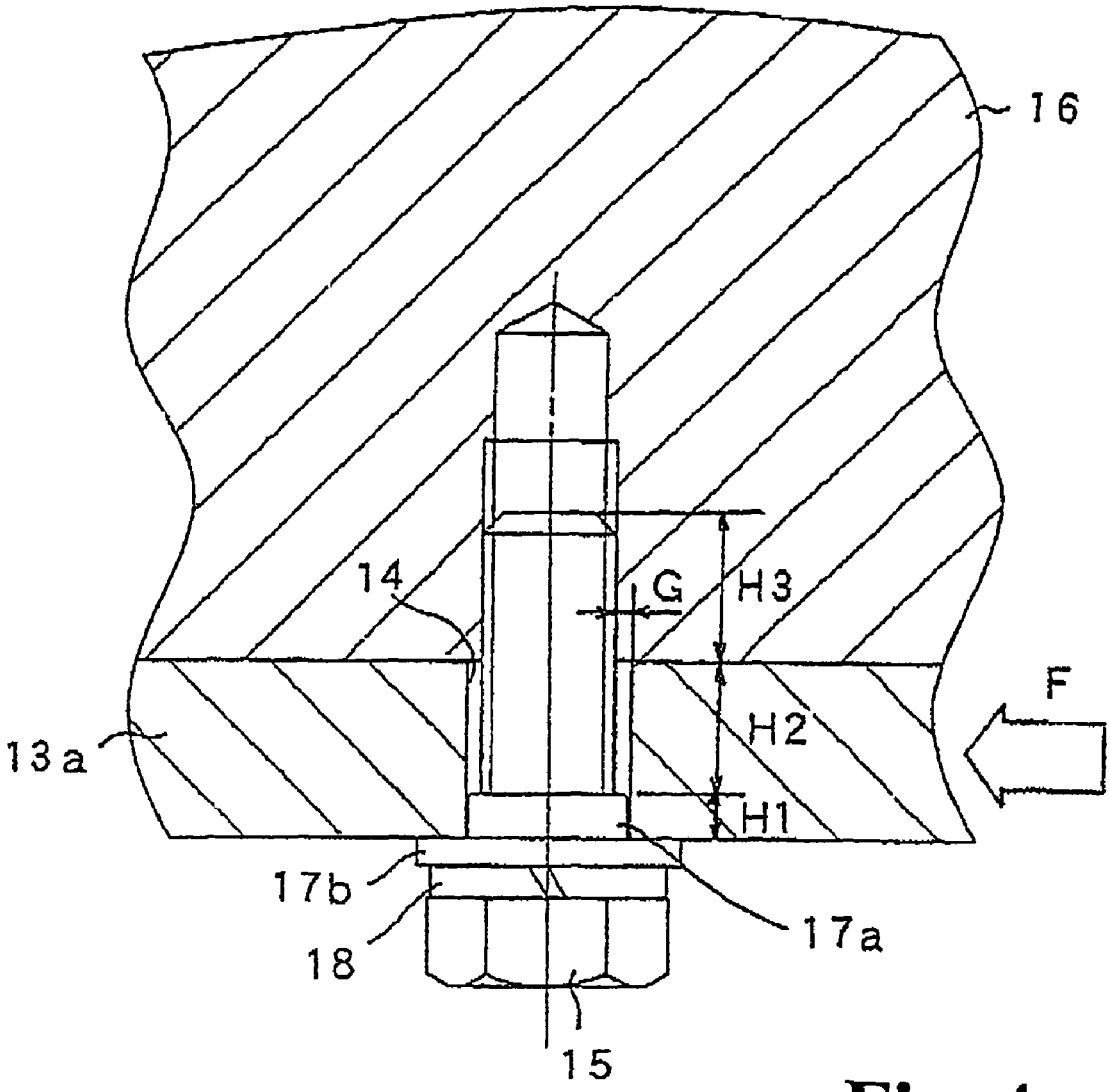
FIG. 4 is a sectional view for explaining an operation of the special washer.

FIG. 4 is a drawing for explaining an operation of the special washer 17, and is a sectional view taken along the circumferential direction of the bolt hole 14. The bolt 15 is screwed into a female screw part of the device side flange 16 at a part from the front end of the shaft to an area H3, and the area H3 is constrained by the device side flange 16. A part of the dimension H2 from the matching surfaces of the flanges 13*a* and 16 becomes in an unconstrained state with a gap G formed between the shaft of the bolt 15 and the inner wall of the bolt hole 14 as described above.

In the state shown in FIG. 4, if an impact force F is applied to the intake port flange 13*a* in the rotor rotation direction (left direction in the illustration), the intake port flange 13*a* move toward the left direction. At this time, while the part in the area H3 of the bolt 15 is constrained by the device side flange 6, the part where the bush part 17*a* of the bolt 15 is installed moves toward the left direction while being constrained by the intake port flange 13*a*. As a result, the shaft of the bolt 15 is deformed at the part of the area H2 being in an unconstrained state. Through the deformation, the kinetic energy from the impact force F is absorbed as strain energy of the bolt 15, and breakage of the bolt 15 is prevented.

The height H1 of the bush part 17*a* should be set smaller as the strain area H2 of the bolt 15 becomes greater. An amount of energy absorption by strain becomes greater as an amount of deformation of the bolt 15 becomes greater, so that the external dimension d of the bush part 17*a* should be set large. Usually, the size (nominal size) of the bolt 15, the number of bolts, the inner diameter of the bolt hole 14, and the pitch circle diameter (PCD) of the bolt hole 14 are determined by standards according to the size of the intake port flange 13*a*. Therefore, in order to match to the device side flange 16, they are set according to the standards other than the inner diameter D of the bolt hole 14 described above.

In the present embodiment, by installing the special washer 17 having the bush 17*a* on each bolt 15, a gap is formed between the bolt 15 and the bolt hole 14, and the unconstrained area H2 can be formed for the bolt 15. As a result, even if impact torque acts on the intake port flange 13*a*, the shear force acting on the bolt 15 is decomposed in two directions of shear force and tensile force by the deformation of the part in the unconstrained area H2 of the bolt 15. Therefore, the shear energy can be stopped as strain energy of the bolt 15, and the impact torque transmitted to the device side can be reduced. Due to the deformation of the bolt 15, because the shear force from the impact torque can be stopped by all the bolts 15 used for fastening, the bolt strength can be utilized effectively, and breakage of the bolts 15 can be prevented.

Figure 5A:
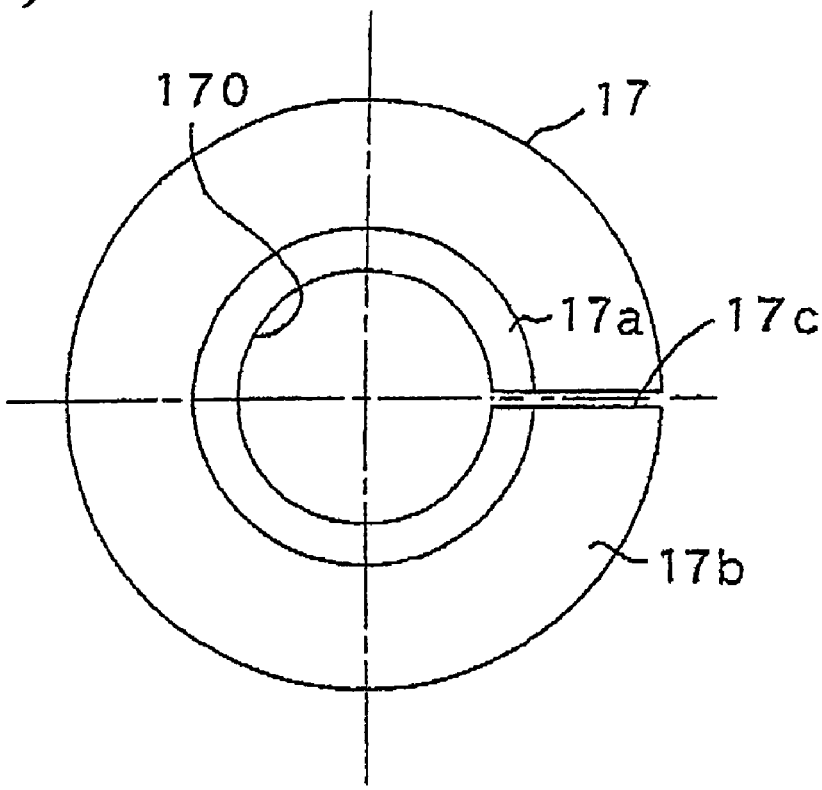
FIG. 5(*a*) is a plan view showing the special washer with a slit, and FIG. 5(*b*) is a sectional view showing a large-diameter part provided on a bush part.
Figure 5B:
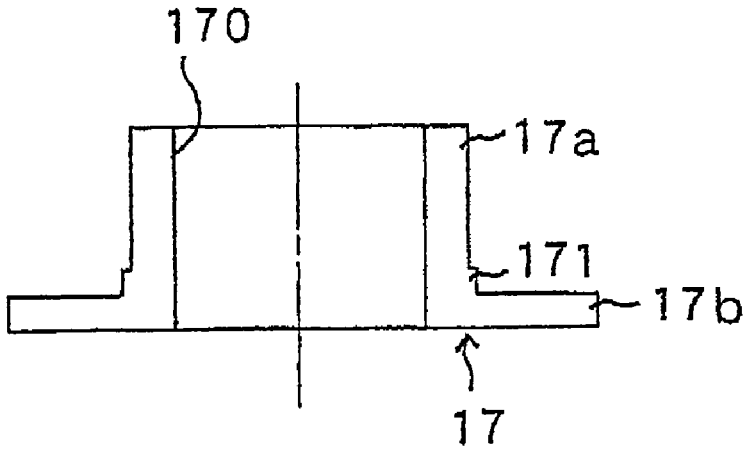

As shown in FIG. 5(*a*), a slit 17*c* is formed in the special washer 17 in the vertical direction, and the bush part 17*a* is pressed into the bolt hole 14 of the intake port flange 13*a*. As shown in FIG. 5(*b*), a large-diameter part 171 having a space for pressing in may be provided on the base part of the bush part 17*a*. The large-diameter part 171 may be pressed or thermally inserted into the bolt hole 14.

By installing the special washer 17 in the bolt hole 14, the operability during pump attachment is improved. As structures of a type in which the special washer 17 is installed in the bolt hole 14 and does not fall out, first to fourth modified examples shown below may be provided.

First Modified Example

Figure 6A:
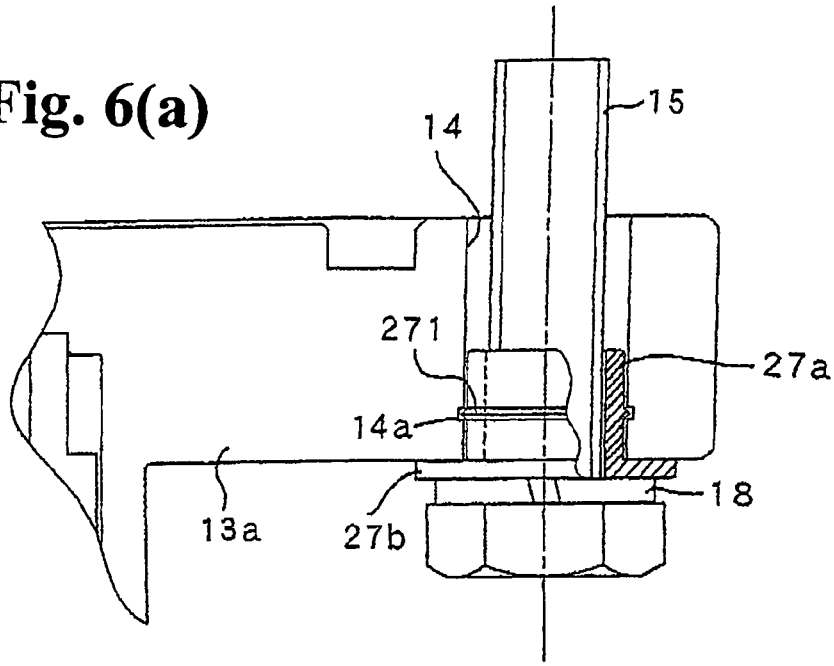
FIGS. 6(*a*) to 6(*c*) are views showing a special washer according to a first modified example, wherein FIG. 6(*a*) is a view showing the special washer attached to a bolt hole, FIG. 6(*b*) is a plan view of the special washer, and FIG. 6(*c*) is a sectional view of the special washer.
Figure 6B:
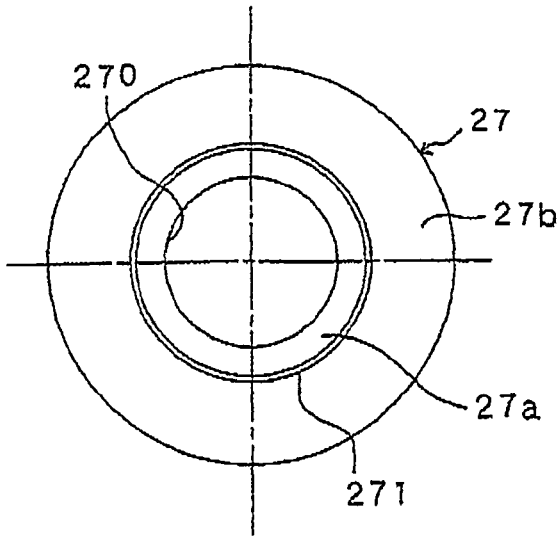
Figure 6C:
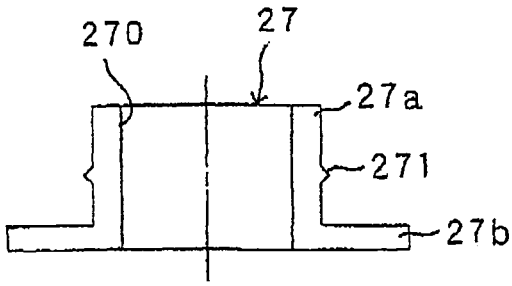

FIGS. 6(*a*) to 6(*c*) are views showing a special washer 27 according to a first modified example, wherein FIG. 6(*a*) is a view showing the special washer 27 attached to a bolt hole 14, FIG. 6(*b*) is a plan view of the special washer 27, and FIG. 6(*c*) is a sectional view of the special washer 27. The special washer 27 also has a bush part 27*a* and a flange part 27*b*, and a bolt hole 270 for bolt is formed in order to run through the bush part 27*a*. On the bush part 27*a*, a raised part 271 which encircles the outer perimeter face is formed.

As shown in FIG. 6(*a*), in the bolt hole 14 of the intake port flange 13*a*, a groove 14*a* which encircles the inner perimeter face is formed. When the bush part 27*a* of the special washer 27 is inserted into the bolt hole 14, the special washer 27 is installed in the bolt hole 14 by coupling of the raised part 271 in the groove 14*a*. Because the raised part 271 and the groove 14*a* are coupled, the special washer 27 does not fall out from the bolt hole 14.

Second Modified Example

Figure 7A:
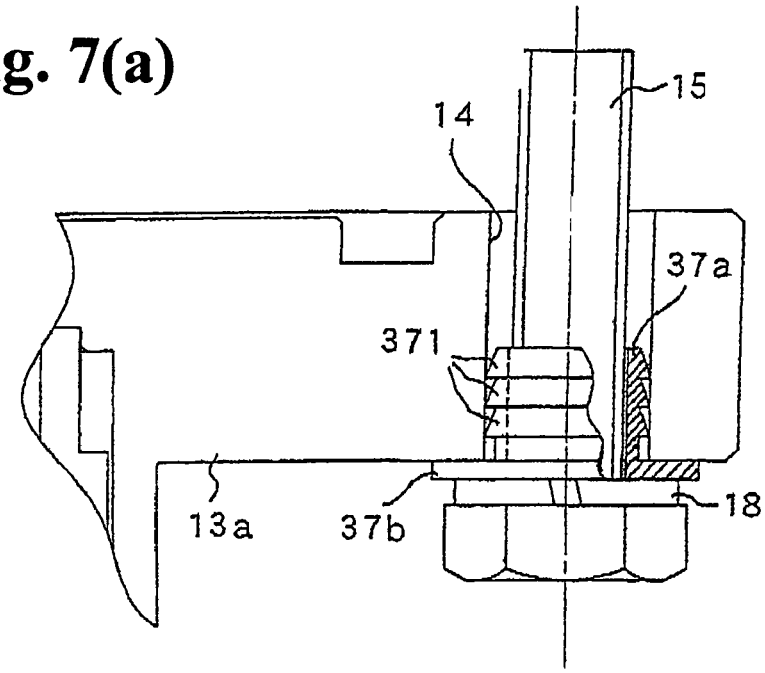
FIGS. 7(*a*) to 7(*c*) are views showing a special washer according to a second modified example, wherein FIG. 7(*a*) is a view showing the special washer attached to a bolt hole, FIG. 7(*b*) is a plan view of the special washer, and FIG. 7(*c*) is a sectional view of the special washer.
Figure 7B:
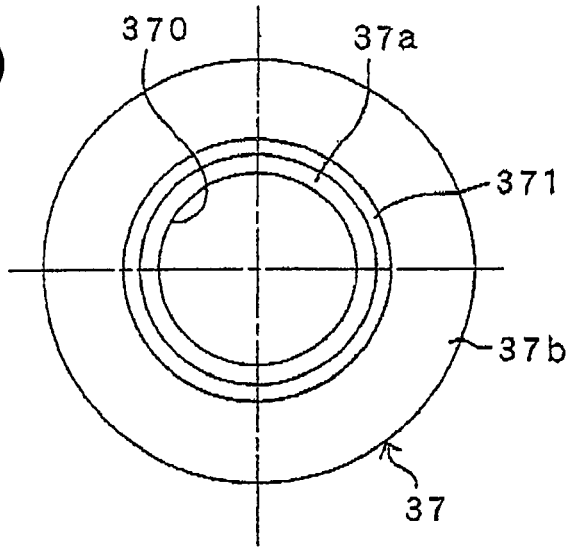
Figure 7C:
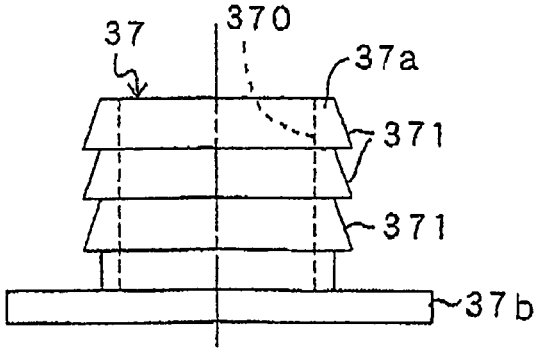

FIGS. 7(*a*) to 7(*c*) are views showing a special washer 37 according to a second modified example, wherein FIG. 7(*a*) is a view showing the special washer 37 attached to a bolt hole 14, FIG. 7(*b*) is a plan view of the special washer 37, and FIG. 7(*c*) is a sectional view of the special washer 37. The special washer 37 also has a bush part 37*a* and a flange part 37*b*, and a hole 370 for bolt is formed in order to run through the bush part 37*a*. On the outer perimeter face of the bush part 37*a*, peak-like protrusions 371 which widen in the direction of the flange part 37*b* are formed in three stages in the axial direction for a hose nipple. The number of stages of peak-like protrusions 371 is not particularly limited, and may be one stage or two stages.

The outer diameter of the peak-like protrusions 371 is set somewhat larger than the inner diameter of the bolt hole 14 formed on the intake port flange 13*a*, and the bush part 37*a* is installed in a manner so as to be pressed into the bolt hole 14. As a result, the special washer 37 does not fall out from the bolt hole 14.

Third Modified Example

FIGS. 8(*a*) to 8(*c*) are views showing a special washer 47 according to a third modified example, wherein FIG. 8(*a*) is a view showing the special washer 47 attached to a bolt hole 14 of the intake port flange 13*a*, FIG. 8(*b*) is a plan view of the special washer 47, and FIG. 8(*c*) is a sectional view of the special washer 47. The special washer 47 also has a bush part 47*a* and a flange part 47*b*, and a hole 470 for bolt is formed in order to run through the bush part 47*a*. On the bush part 47*a*, a groove 471 which encircles the outer perimeter face is formed.

As shown in FIG. 8(*a*), on the intake port flange 13*a*, a screw hole 140 which extends through from the side face to the bolt hole 14 is formed. The screw hole 140 is formed so as to face the groove 471 of the bush part 47*a* inserted into the bolt hole 14. The special washer 47 is fixed in the bolt hole 14 by pushing a setscrew 141 inserted into the screw hole 140 against the groove 471 of the bush part 47*a* inserted into the bolt hole 14. By putting the special washer 47 in a state attached to the bolt hole 14, it is possible to prevent falling off, loss, and the like, of the special washer 47. The special washers 17, 27, 37 and 47 described above had the bush parts 17*a*, 27*a*, 37*a* and 47*a* and the flange parts 17*b*, 27*b*, 37*b* and 47*b* integrally formed. The bush parts 17*a*, 27*a*, 37*a* and 47*a* and the flange parts 17*b*, 27*b*, 37*b* and 47*b* may be provided separately as separate parts. In that case, ordinary washers may be used in place of the flange parts 17*b*, 27*b*, 37*b* and 47*b*.

Fourth Modified Example

The special washer 17 described above has the circular flange part 17*b* and the round columnar bush part 17*a*. A special washer 57 shown in FIGS. 9(*a*) to 9(*c*) may be constituted by a oblong-shaped flange part 57*b* and a columnar bush part 57*a* having an oblong shape in section. A hole 570 for bolt is formed in the bush part 57*a*. In FIGS. 9(*a*) to 9(*c*), FIG. 9(*a*) is a plan view of the special washer 57, FIG. 9(*b*) is a sectional view taken along 9(*b*)-9(*b*) in FIG. 9(*a*), and FIG. 9(*c*) is a sectional view taken along 9(*c*)-9(*c*) in FIG. 9(*a*).

Figure 10B:
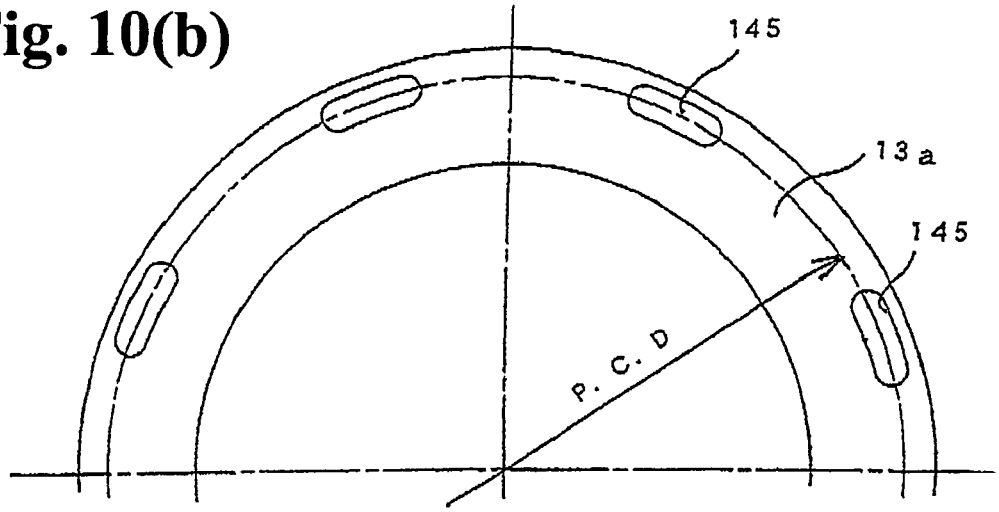
FIGS. 10(*a*) and 10(*b*) are views showing a turbo molecular pump with the special washer shown in FIGS. 9(*a*) to 9(*c*), wherein FIG. 10(*a*) is a sectional view, and FIG. 10(*b*) is a plan view showing a flange part.
Figure 10A:
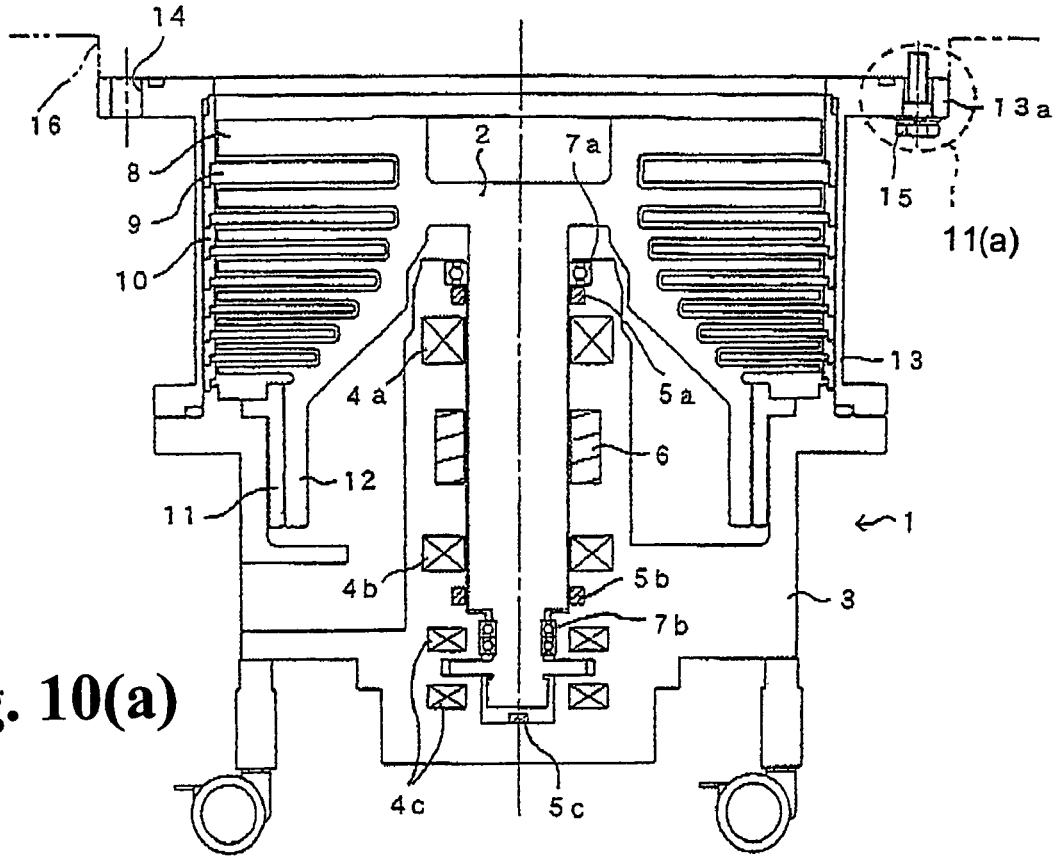

FIGS. 10(*a*) and 10(*b*) are views showing a turbo molecular pump 1 with the special washer 57 shown in FIGS. 9(*a*) to 9(*c*), wherein FIG. 10(*a*) is a sectional view, and FIG. 10(*b*) is a plan view showing a flange part. The plan view shows the upper half of the intake port flange 13*a*. FIGS. 10(*a*) and 10(*b*) are similar to FIGS. 1(*a*) and 1(*b*), and shapes of the bolt holes formed in the intake flange 13*a* are different.

A long hole 145 is formed in place of the circular hole 14 for a bolt. The same number of the long holes 145 as the bolt holes 14 shown in FIG. 1(*b*) is formed, and the pitch circle diameter (PCD) of the bolt hole also is set equally. The horizontal sectional shape of the long hole 145 is the same as the horizontal sectional shape of the bush part 57*a*, and the bush part 57*a* of the special washer 57 is inserted inside this long hole 145. The long diameter direction of the long hole 145 matches to the circumferential direction (that is, the rotor rotation direction).

Figure 11A:
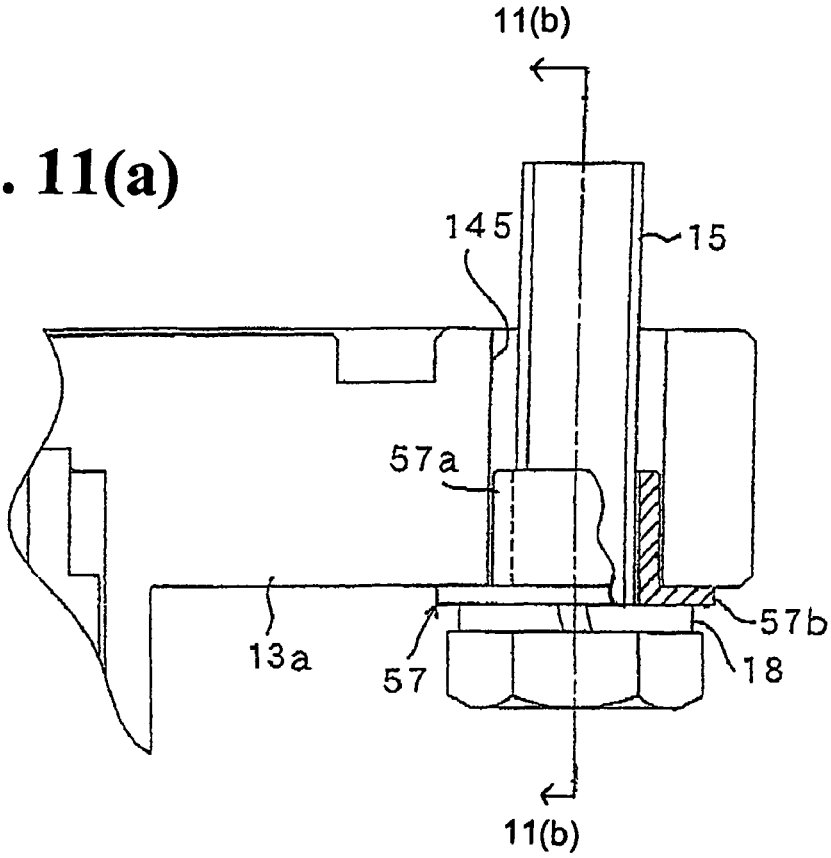
FIGS. 11(*a*) and 11(*b*) are views showing a long hole shown in FIG. 10(*b*), wherein FIG. 11(*a*) is an enlarged view of a part 11(*a*) in FIG. 10(*b*), and FIG. 11(*b*) is a sectional view taken along 11(*b*)-11(*b*) in FIG. 11(*a*)
Figure 11B:
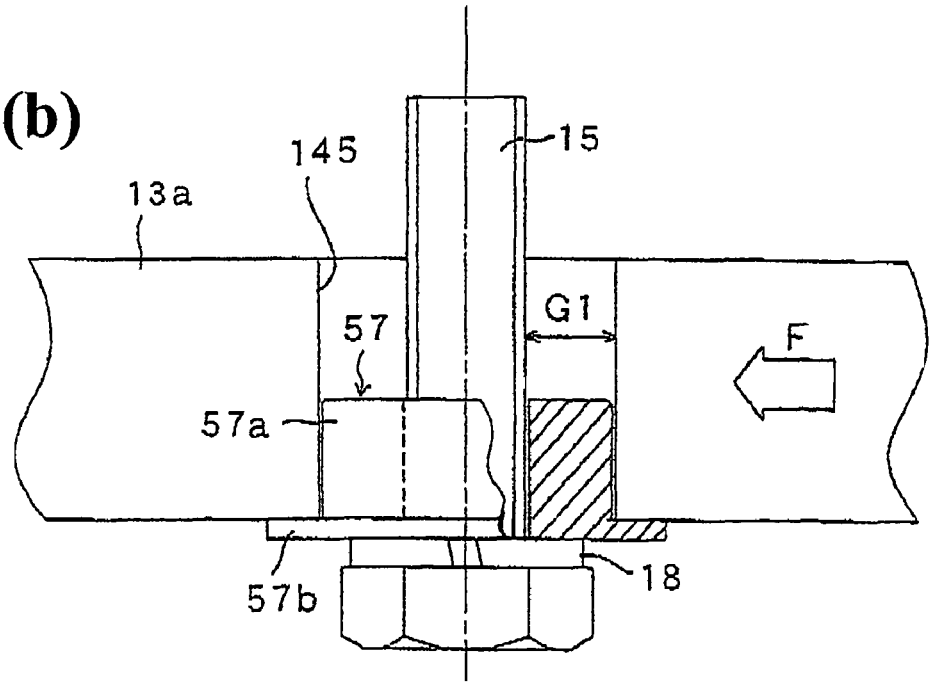

FIGS. 11(*a*) and 11(*b*) are views showing the long hole 145, wherein FIG. 11(*a*) is an enlarged view of a part 11(*a*) in FIG. 10(*b*), and FIG. 11(*b*) is a sectional view taken along 11(*b*)-11(*b*) in FIG. 11(*a*). As described above, because the long diameter direction of the long hole 145 matches to the rotor rotation direction, as shown in the sectional view along 11(*b*)-11(*b*), the gap G1 in the rotor rotation direction is set larger than the gap G shown in FIG. 2. Therefore, when an impact force F acts on the intake port flange 13*a*, the shaft of the bolt 15 can be deformed greatly. As a result, the absorption of the impact energy by the strain energy accompanying the deformation can be accomplished more effectively.

As shown in FIG. 11(*a*), because the gap is formed in the diameter direction between the bolt 15 and the long hole 145, when there is deformation in the diameter direction of the intake port flange 13*a*, the bolt 15 is deformed in the diameter direction, and breakage of the bolt 15 related to the diameter direction also can be prevented.

Second Embodiment

Figure 12:
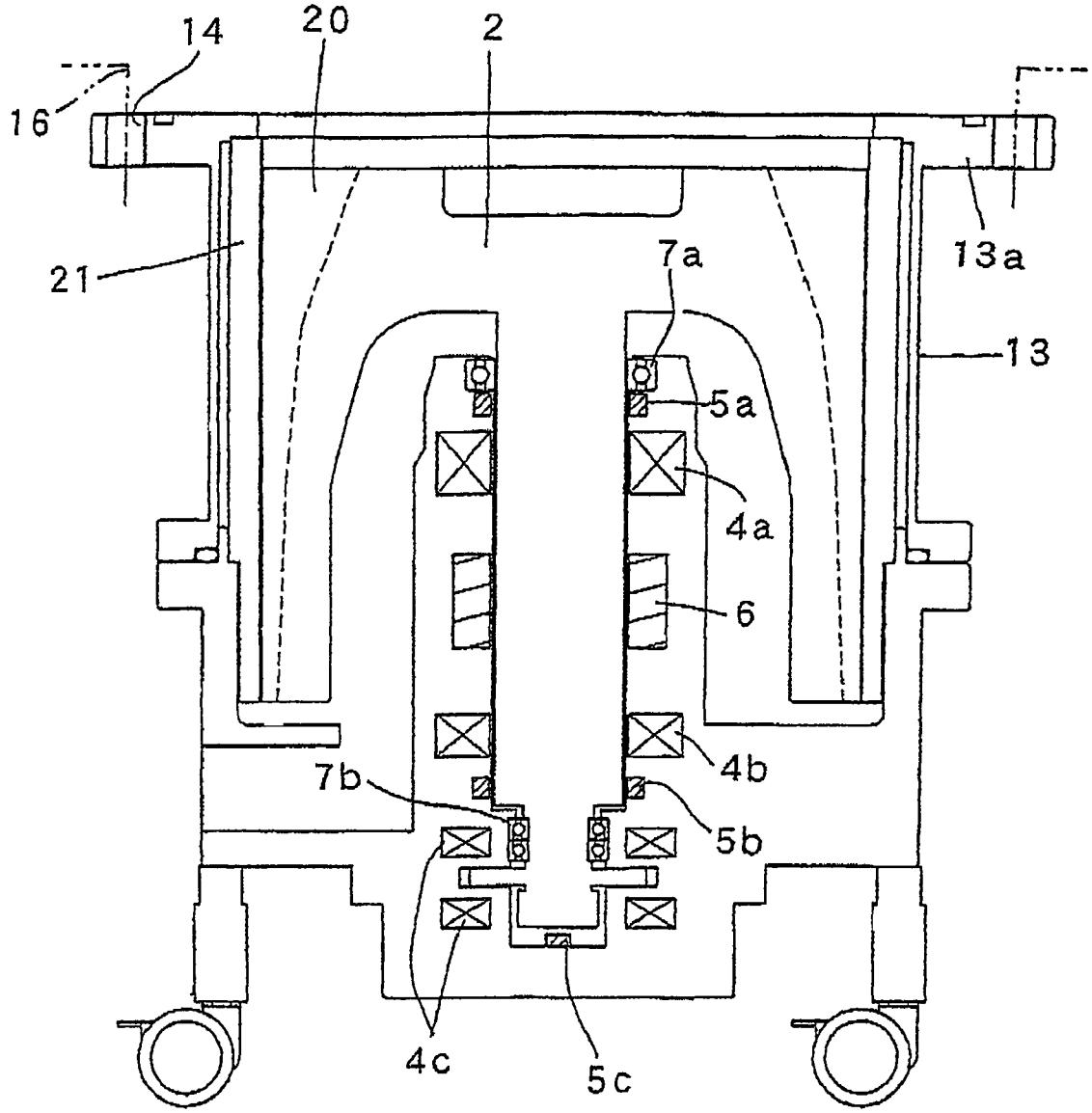
FIG. 12 is a sectional view showing a molecular drag pump as a rotary vacuum pump according to a second embodiment of the present invention.

In the first embodiment described above, the turbo molecular pump is explained. In the present embodiment, a molecular drag pump is explained. FIG. 12 is a sectional view showing a general constitution of a molecular drag pump. The molecular drag pump shown in FIG. 12 is a magnetic bearing type rotary vacuum pump, and a magnetic bearing part and a rotation driving part use the same structures as the turbo molecular pump shown in FIG. 1. Parts of different constitution will be explained.

In the molecular drag pump shown in FIG. 12, a screw groove part 20 is formed in the outer perimeter face of the rotor 2, and a cylindrical stator 21 is provided on the periphery of the rotor 2 so as to face the screw groove part 20. A gap between the screw groove part 20 and the stator 21 is set to 1 mm or less, the pump effect is generated by high-speed rotation of the rotor 2 to evacuate gas. The molecular drag pump having such a structure exhibits a capability in a higher pressure region compared with a turbo molecular pump. The screw groove 20 may be formed in the stator 21, and the outer perimeter of the rotor 2 may be made cylindrical.

The molecular drag pump rotates at a high speed of several tens of thousands of rpm just as a turbo molecular pump. When the rotor 2 and the stator 21 contact or the rotor is suddenly stopped by contact, or the like, a great impact is applied to the stator side. In particular, different from the turbo molecular pump having the turbine fins, in the molecular drag pump, because the screw groove part extends from the upper end to the lower end, the rotor weight tends to become greater compared with the turbo molecular pump having the same aperture, and the impact becomes greater by that amount.

Therefore, in the present embodiment, the fixing method of the intake port flange 13*a* of the molecular drag pump and the flange 16 of the device side vacuum chamber uses the same fixing method as in the first embodiment. For example, just like the structure shown in FIG. 2, the special washer 17 and the spring washer 18 are used for the bolt 15. The bolt hole 14 of the intake port flange 13*a* has a hole diameter for the special washer 17.

Figure 13:
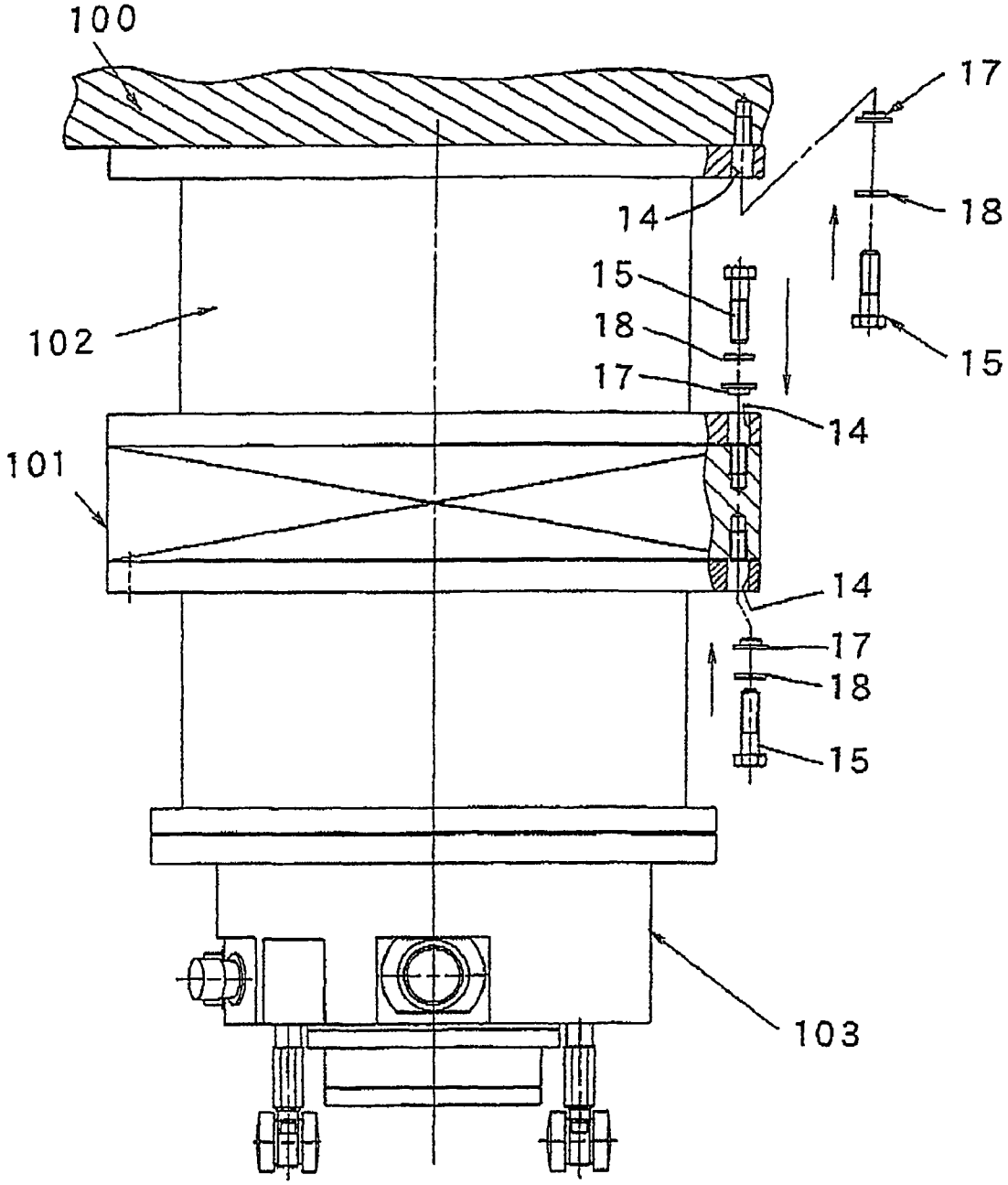
FIG. 13 is a view showing a valve and a piping provided between the rotary vacuum pump and a vacuum chamber.

When installing the rotary vacuum pump 103 such as a turbo molecular pump or molecular drag pump on a vacuum chamber, it is often fixed by means of a valve such as a gate valve or control valve as shown in FIG. 13. The valve 101 is fixed to the vacuum chamber 100 by means of piping 102. In the case of such a constitution, in order to suppress impact to the vacuum chamber 100, the same fixing method as in the first embodiment is used in each fixing part of the valve 101 and piping 102. As a result, the absorption of impact energy by strain energy accompanying bolt deformation can be accomplished more effectively, and breaking damage of the bolt 15 also can be prevented.

In the example shown in FIG. 13, the screw hole for the bolt 15 is formed in the valve 101, the through-hole 14 is formed in the intake port flange 13*a* on the pump side, and the special washer 17 is installed on the intake port flange 13*a*. In the case of a flange structure in which a through-hole for bolt is formed on the valve side, the special washer 17 may be installed on either the flange on the pump side or the valve side. This is the same in relation to the connection part between the valve 101 and the piping 102 and the connection part between the piping 102 and the vacuum chamber 100.

Figure 14:
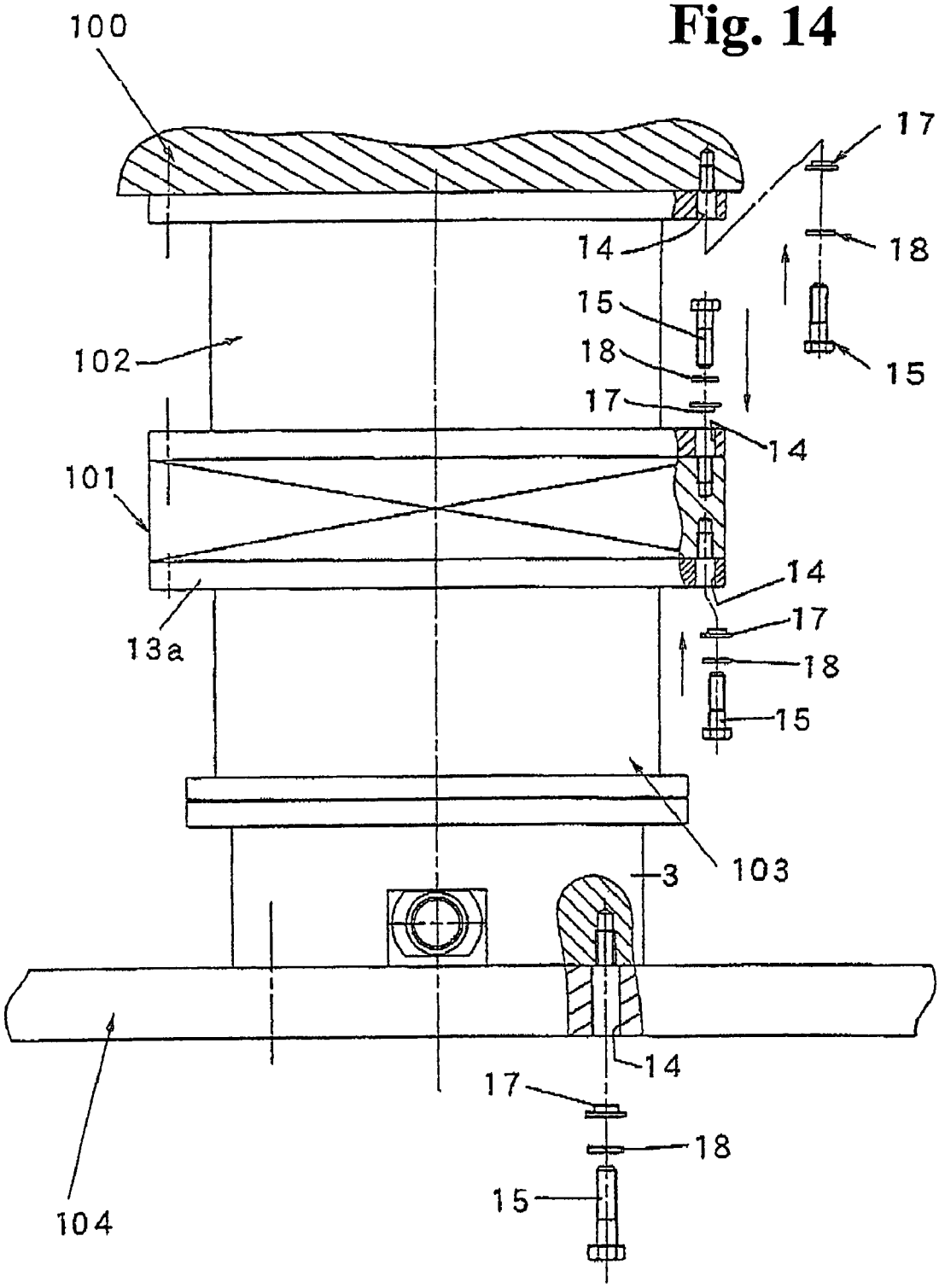
FIG. 14 is a view showing a frame provided on a device.

In the attachment structure in FIG. 13, the rotary vacuum pump 103 is fixed so as to be suspended on the valve 101, and may be made such that the bottom face of the base 3 of the vacuum pump 103 is fixed on the device side frame 104 as in FIG. 14. For the fixing method of the bottom face of the base and the frame 104, the same fixing method as in the first embodiment described above is used. For example, it is fixed using the special washer 17, the spring washer 18, and the bolt 15. In the frame 104, the bolt hole 14 corresponding to the special washer 17 is formed.

When installing the rotary vacuum pump 103 on a device in this manner, not only the intake port flange 13*a* of the vacuum pump 103 is fixed to the device, but by fixing the pump base part also to the device, the energy during exceptional conditions such as sudden stoppage of the pump can be absorbed by plastic deformation of more bolts, and the impact transmitted to the device side can be reduced. In particular, in the case when constituted as shown in FIG. 14, because the energy is also released to the frame side, damage to the vacuum chamber 100, the piping 102, and the valve 101, being important parts for the device, can be reduced. The fixing method of the present embodiment can be implemented easily in each connection place of the vacuum device by installing a gap forming device such as a bush on the bolt through-hole provided from the past.

Figure 15:
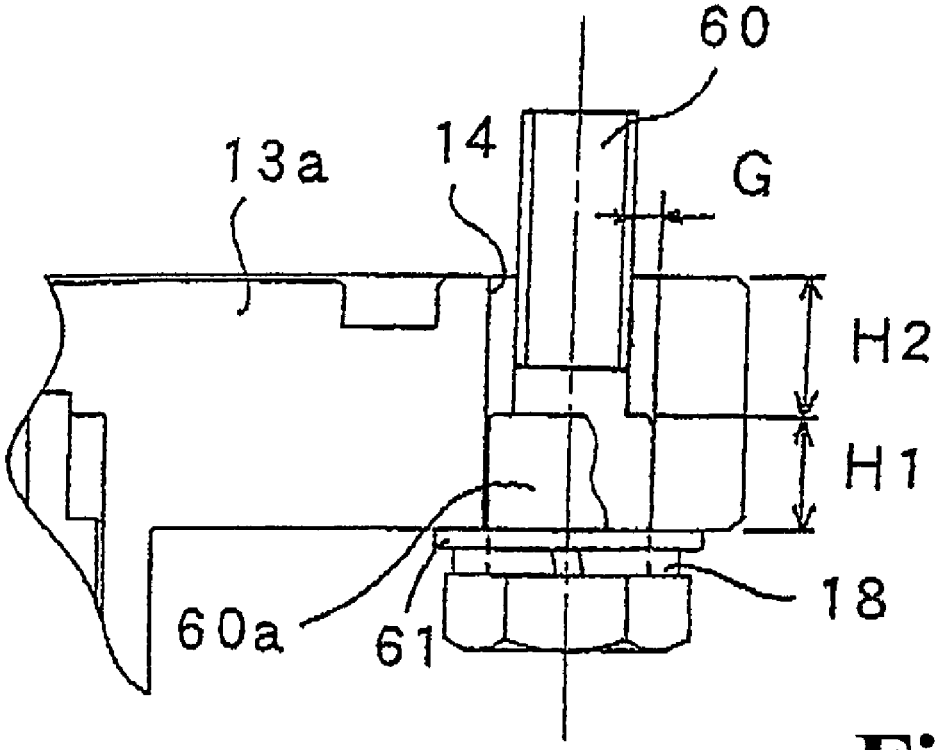
FIG. 15 is a sectional view showing a stepped bolt.

In the embodiments described above, the special washers 17, 27, 37, 47 and 57 are used as the means for forming the gap between the bolt 15 and the bolt hole 14. Instead of the special washers 17, 27, 37, 47 and 57, a stepped bolt 60 as shown in FIG. 15 may be used in place of the bolt 15. The stepped bolt 60 has a part beneath the neck having length H1 as a large-diameter part 60*a* having almost the same size as the inner diameter of the bolt hole 14. The gap G is formed by providing the large-diameter part 60*a*. Reference numeral 61 is a common flat washer.

The present invention is not limited to the above embodiments as long as it does not impair the characteristics of the present invention. The magnetic bearing type rotary vacuum pump in which the rotor 2 is supported by the magnetic bearings without contact is explained as an example. The present invention is not limited to the magnetic bearing type, and can be applied to a rotary vacuum pump using mechanical bearings.

In the correspondences between the embodiments explained above and elements in the claims, the bolt hole 14 constitutes the through-hole, the bush parts 17*a*, 28*a*, 38*a*, 48*a* and 57*a* constitute the gap forming device and the bush, the flange parts 17*b*, 27*b*, 37*b*, 47*b* and 57*b* constitute the washer, the frame 104 constitutes the pump supporting part, the rotating fins 8, the cylindrical part 12, and the screw groove part 20 constitute the rotating side evacuating device, and the fixed fins 9, the screw stator 11, and the stator 21 constitute the fixed side evacuating device.

The disclosures of Japanese Patent Applications No. 2004-223265 filed on Jul. 30, 2004 and No. 2005-114519 filed on Apr. 12, 2005 are incorporated herein.

While the invention has been explained with reference to the specific embodiments of the invention, the explanation is illustrative and the invention is limited only by the appended claims.

What is claimed is:

1. A rotary vacuum pump comprising:

a pump casing having an intake port flange to be fixed to a device for evacuation, said intake port flange having a first through-hole and a thickness, a rotor situated in the pump casing for rotation, and having a rotating side evacuating device, a fixing side evacuating device disposed in the pump casing for evacuation together with the rotating side evacuating device, a first bolt inserted into the first through-hole, said first bolt having a diameter less than that of the first through-hole, and a first gap forming device for forming a gap between the bolt and the through-hole so that the pump casing is fixed to the device for evacuation by the first bolt and the first gap forming device, wherein said first gap forming device is a bush inserted between the first bolt and the first through-hole and including a bush part and a flange part integrally formed together, said bush part having a height less than the thickness of the intake part flange and being made of iron or stainless steel.

2. A rotary vacuum pump according to claim 1, wherein said bush forms the gap having a length in the rotor rotation direction larger than a length in a diameter direction of the intake port flange.

3. A rotary vacuum pump according to claim 1, wherein said bush is fixed to the first through-hole.

4. A rotary vacuum pump according to claim 1, wherein said bush is integrated with a washer for the first bolt.

5. A rotary vacuum pump according to claim 1, wherein said first gap forming device includes a large-diameter portion situated on a shaft of the first bolt adjacent to a bolt head of the first bolt and having an outer diameter substantially same as an inner diameter of the first through-hole.

6. A vacuum device comprising a vacuum chamber, the rotary vacuum pump according to claim 1 and fixed to the vacuum chamber, a pump supporting part fixed to an end surface of the rotary vacuum pump, a second through-hole formed in the pump supporting part for inserting a second bolt and having a diameter larger than that of the second bolt, and a second gap forming device disposed in the second through-hole for forming a gap between the second bolt and the second through-hole.

7. A pump connection structure for connecting first and second flange members for a rotary vacuum pump, comprising:

a bolt for connecting the first and second flange members, a through-hole formed in one of the first and second flange members for inserting the bolt and having a diameter larger than that of the bolt, and a gap forming device disposed in the through-hole for forming a gap between the bolt and the through-hole, wherein said gap forming device is a bush inserted between the bolt and the through-hole, and including a bush part and a flange part at one side of the bush part, said bush part having a height less than a thickness of the first or second flange member where the through-hole is formed and being made of iron or stainless steel.

8. A pump connection structure according to claim 7, wherein said first flange member is an intake port flange for the rotary vacuum pump which exhausts gas by rotating a rotor relative to a stator, and said second flange member is a member to which said rotary vacuum pump is connected.

9. A pump connection structure according to claim 7, wherein said first flange member is a connection flange for a first piping member, and said second flange member is a connection flange of a second piping member for the rotary vacuum pump.

10. A pump connection structure according to claim 7, wherein said bush forms the gap having a length in a rotational direction of a rotor of the rotary vacuum pump larger than a length in a diameter direction of the intake port flange.

11. A pump connection structure according to claim 7, wherein said bush is fixed to the through-hole.

12. A pump connection structure according to claim 9, wherein said bush is integrated with a washer for the bolt.

13. A pump connection structure according to claim 7, wherein said gap forming device includes a large-diameter portion situated on a shaft of the bolt adjacent to a bolt head of the bolt and having an outer diameter substantially same as an inner diameter of the through-hole.

14. A pump connection structure according to claim 7, wherein said bush part includes at least one annular projecting portion projecting radially outwardly therefrom, or annular dent.

* * * * *